United States Patent [19]

Eckels

[11] 4,069,760

[45] Jan. 24, 1978

[54] METHOD FOR DRIVING A SHAFT WITH SHAPED CHARGES

[76] Inventor: Robert E. Eckels, 2104 Youngfield St., Golden, Colo. 80401

[21] Appl. No.: 662,508

[22] Filed: Mar. 1, 1976

[51] Int. Cl.[2] ..... F42D 1/02; F42D 3/04

[52] U.S. Cl. ..... 102/23; 102/24 HC; 175/4.6; 175/53

[58] Field of Search ..... 102/23, 24 HC; 175/4.5, 175/4.6, 53, 62; 299/13, 19

[56] References Cited

U.S. PATENT DOCUMENTS

| | | | |
|---|---|---|---|
| 1,502,030 | 7/1924 | Goodney | 299/19 X |
| 2,823,900 | 2/1958 | Kandle | 175/53 X |
| 2,897,756 | 8/1959 | Borins et al. | 102/24 HC X |
| 3,348,482 | 10/1967 | Keener et al. | 102/23 |
| 3,441,096 | 4/1969 | Lautsch | 175/53 X |
| 3,486,572 | 12/1969 | Hamilton et al. | 175/53 |
| 3,659,660 | 5/1972 | Conn | 175/53 |
| 3,695,715 | 10/1972 | Godfrey | 175/4.5 X |
| 3,741,119 | 6/1973 | Eckels | 102/24 HC X |
| 3,905,430 | 9/1975 | Poundstone | 175/53 |
| 3,972,285 | 8/1976 | Brown | 102/24 HC X |
| 3,975,056 | 8/1976 | Peterson | 175/53 X |

FOREIGN PATENT DOCUMENTS

| | | | |
|---|---|---|---|
| 698,978 | 10/1953 | United Kingdom | 175/53 |

*Primary Examiner*—David H. Brown
*Attorney, Agent, or Firm*—Richard D. Law

[57] ABSTRACT

A method of driving a shaft, or tunnel into competent hard rock with shaped charges. An array of shaped charges to nearly conform with the bottom of the shaft, or face of the tunnel, is carried upon a framework which places the charges a proper distance from the bottom or face surface. Detonation causes the shaped charge jets to penetrate and break several feet into the rock to advance the shaft or tunnel. The loose rock may then be mucked out of the shaft, or tunnel, and the operation repeated. A shaft may be driven downwardly or upwardly by these operations.

12 Claims, 17 Drawing Figures

METHOD FOR DRIVING A SHAFT WITH SHAPED CHARGES

The present invention relates to driving shafts and tunnels in hard rock, and more particularly to driving shafts with explosive-shaped charges in lieu of conventional drilling and boring operations. As such, designating shafts, raises, winzes, and tunnels as "shafts," the invention will be hereinafter called a "Method for Driving a Shaft With Shaped Charges."

The invention is especially adapted for driving shafts in competent hard rock such as granite. The advantages to be gained over conventional methods of driving a shaft in brecciated and disintegrated rock formations are uncertain at this time. However, if found desirable, the procedures for the most part will be no different than those hereinafter described. Accordingly, the invention is not necessarily confined to any particular type of rock.

Explosive shaped charges, as used in connection with rock breaking, are cylindrical canisters of explosives with a lined, concave, conical end, well known to the art. This end, upon detonation of the charge within the canister, is cumulated to an axial jet of exceedingly high velocity capable of penetrating several feet into the hardest of rock. It has been found that if a plurality of shaped charges are arranged in a properly-spaced array over a selected area of a rock surface and then simultaneously detonated, the penetration of the shaped-charge jets into the rock will break up the rock within the selected area. This is disclosed in my U.S. Pat. No. 3,741,119 issued June 26, 1973. That patent is concerned with the use of shaped charges to break up rock formations under water as for underwater trenching.

The manner in which a plurality of shaped charges is spaced to properly break up a rock formation is largely empirical because the hardness and toughness of various types of rock, and even the same types of rocks, will vary considerably. Ordinarily, tests on a rock formation can be made by spacing shaped charges at varying distances apart, detonating the charges, and observing the breakup. The explosive engineer can then establish the best pattern for a given result. Subsequent to the developments disclosed in the U.S. Pat. No. 3,741,119, studies have been made to establish criteria for further controlling the breaking of rock by shaped charges, including the discovery that the rock wall sides of an excavation made with shaped charges can be controlled with a surprising degree of accuracy. This led to the present invention which involves the use of shaped charges to drive shafts and tunnels.

Where small diameter shafts are required, they may be drilled or bored. Larger shafts and tunnels may be constructed by drill-load-shoot-muck methods. Such methods have not changed greatly over the years, although better drills, more powerful explosives and mechanical mucking machinery is now available. Regardless of the improvement, the progress, down a vertical shaft or in a horizontal tunnel, is generally slow. In more recent times, an uphole method for boring vertical shafts, up to about 12 feet in diameter, has been introduced and can be used where a drift at the bottom of the shaft is available to permit mucking operations to proceed with the boring operation. A pilot hole, 9 to 12 inches in diameter, is drilled from an upper surface to the drift, a stem is extended into the pilot hole, a bit having roller cutters is connected to the stem which is then rotated and pulled upward with a considerable force. Where it can be used, this method is an improvement over the drill-load-shoot-muck methods of the past; however, the machinery required for this method is heavy and expensive.

There is thus, a need for improved methods for driving shafts and tunnels. The present invention was conceived and developed with this need in view and the invention comprises, in essence, a shaft driving operation which uses an array of shaped charges carried upon a frame to be properly placed at the bottom of a shaft, at the face of a tunnel, or at the ceiling of an uphole shaft. After detonation, the broken rock is mucked, or, driving up, is dropped, and the placement of spaced charges is repeated at the advanced position.

Thus, an object of the present invention is to provide a novel and improved method for driving a shaft with shaped charges by a place-shoot-muck, or, where dropping the muck, place-shoot, sequence of operations which is considerably faster and less expensive than are conventional drill-load-shoot-muck sequences of operations.

Another object of the invention is to provide a novel and improved method for driving an uphole shaft with shaped charges from an access tunnel at the bottom of the shaft which is rapid, economical and does not require heavy, expensive machinery needed for conventional uphole boring operations, allowing a place-shoot sequence.

Another object of the invention is to provide a novel and improved method for driving a vertical shaft with shaped charges which does not necessarily require the use of workmen within the shaft, but permits the driving operation to proceed largely by remote control.

Another object of the invention is to provide a novel and improved method for driving a shaft with shaped charges which, when water problems are encountered, does not require constant pumping of the water but in contrast may proceed with water in the shaft.

Another object of the invention is to provide a novel and improved method for stoping a vein of ore between different access levels which is rapid and economical.

Another object of the invention is to provide a novel and improved method for boring a shaft which may be practiced by regular mining crews with a limit of detailed instruction With the foregoing and other objects in view, my present invention comprises certain constructions, combinations and arrangements of materials, and sequences, operations and steps, all as hereinafter described in detail, defined in the appended claims, and supplemented by the accompanying drawing in which:

Figure 2:
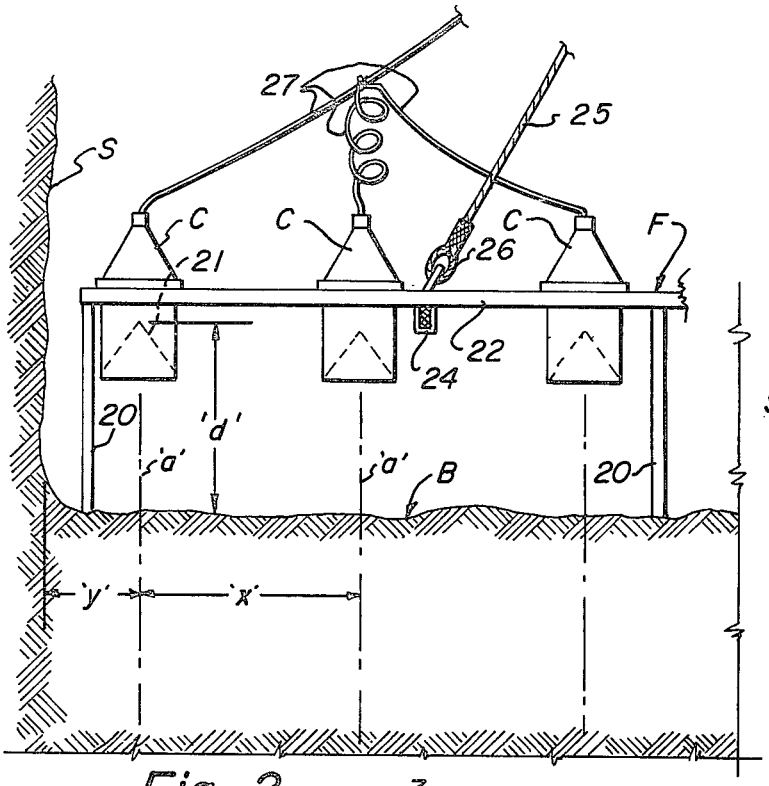
FIG. 2 is a fragmentary sectional detail of a portion of the shaft shown at FIG. 1, and a few of the shaped charges in position upon the frame.
Figure 1:
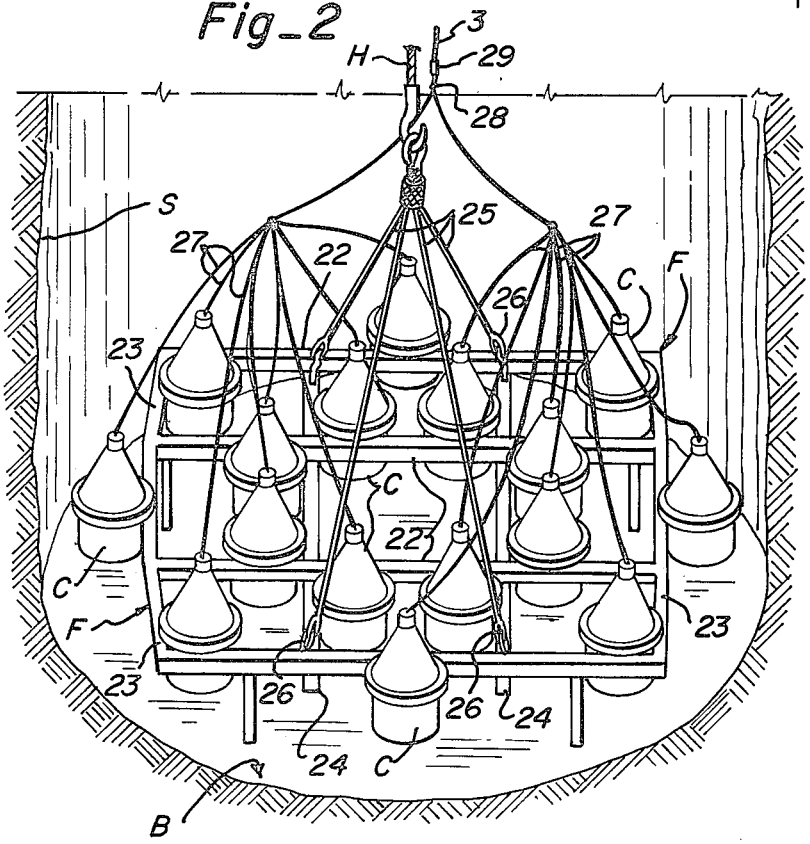
FIG. 1 is a fragmentary isometric section of the bottom of a shaft and an array of downwardly directed shaped charges suspended therein upon a suspended framework, with the charges being armed and ready for detonation.

Referring to the drawings, FIGS. 1 and 2 depict an arrangement of shaped charges C for driving a vertical shaft S by directing the charges downwardly and against the floor B of the shaft. A framework F carrying spaced charges, is lowered into the shaft by a hoist cable H and is then supported upon standoff legs 20 to place the charges a proper distance '*d*' above the floor B of the shaft. The shaped charges C are carried in cylindrical caissons mounted upon the framework in a selected array as will be described. Each charge is formed with a concaved conical bottom 21, shown in broken lines at FIG. 2, and upon detonation of the charge, this confirguation will produce a downward axial jet along the axis line '*a*' which is capable of penetrating several feet into the rock formation of the shaft floor B.

A framework F for supporting the spaced charges, as illustrated at FIG. 1, will include a group of longitudinal beams 22 and headers 23 between the beams 22. This arrangement of beams and headers may be varied in any suitable manner to fit into the shaft and to accommodate a selected array of properly spaced, shaped charges as hereinafter described. The shaped charges C may be attached to the sides of these beams and headers in any suitable manner, not shown, as with straps, lugs or bolts. The frame F is carried upon cross sills 24 and each strand of a four-strand hoist sling 25 is attached to slips 26 near the ends of the cross sills to extend upwardly to the hook of hoist cable H. The legs 20, which depend from this framework, will, in some instances, support the framework when the caissons are in justaposed positon, and the hoist cable H and the sling 25 will be removed prior to detonation of the charges C.

Figure 3:
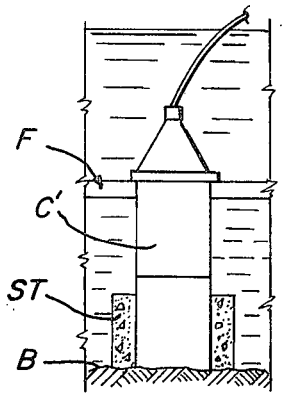
FIG. 3 is a fragmentary detail, partially sectioned, to show how a shaped charge may be used under water within a shaft.

No significant modifications to this framework will be necessary if the shaped charges are to be detonated under water, as where a shaft is partially filled with water, except the addition of ballast weighting and watertight standoff of concrete ST, for example. Basically, it will be necessary to lower each shaped charge to the floor B of the shaft S as indicated at FIG. 3 and accordingly, the frame legs 20, heretofore described, will not be necessary. The arrangement of a shaped charge C', secured to a frame member F and submerged underwater, is indicated at FIG. 3.

It is important that the array of shaped charges C, mounted on the framework F, be detonated substantially simultaneously. Each spaced charge may be detonated by an electrical blasing cap within the charge with all the caps connecting with a common wire. Preferably, however, each of these spaced charges will be connected with equal lengths of detonator type fuse 27, such as "Primacord" manufactured by the Ensign-Bickford Company, and all of the fuses 27 meet at a common connection point 28. An electrical detonating cap 29 is located beyond the connection point 28. Electrical leads 30 from this cap extend to a battery or blasting charger at a location remote from the charges C.

The simultaneous detonation of the shaped charges C will cause the jets formed by these charges to penetrate several feet into the rock at the floor B of the shaft below the shaped charges in a manner which will set up patterns of shock waves emanating from each point of penetration. The shock waves will include compression and tension phases and the wave movement from each point of penetration will interfere with the wave movement at other points of penetration to momentarily form areas of very high compression and tension. It may be difficult to establish an optimum pattern in a rock structure; however, if the shaped charges are properly spaced, the rock beneath them and between them will be broken. It is to be concluded that major breaking occurs where high tension forms due to the wave action from each penetration line. Since it is necessary to rely upon actual observations to establish the best spacing of shaped charges for effectively breaking a given type of rock, the spacing '*x*' between the spaced charges and the spacing '*y*' between a spaced charge and the wall W of the shaft, which is indicated at FIG. 2, will be established by simple tests, that is, by detonating spaced charges at different spacings against a selected rock formation. Actually, the spacing '*x*' between the spaced charges can be varied somewhat: generally, the greater the spacing, the larger the broken rock pieces after the detonation of the charges.

Figure 4:
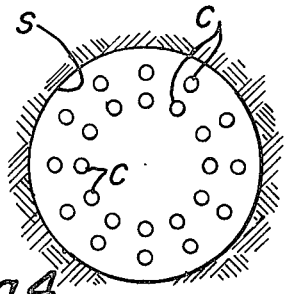
FIG. 4 is a diagrammatic view showing the bottom of a circular shaft and an array of shaped charges for driving a shaft.
Figure 5:
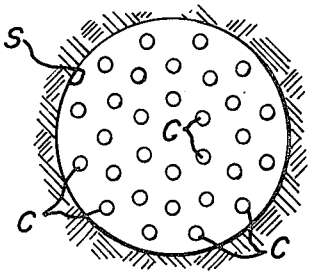
FIG. 5 is a diagrammatic view similar to FIG. 4, but illustrating another arrangement of shaped charges where it is desired to break the rock at the bottom of the shaft into smaller particles.

Ordinarily, a shaft will be circular in section and the array of shaped charges shown at FIG. 1 consists of an outer ring of eight charges adjacent to the shaft wall and an inner ring of eight charges, all in the form of a symmetrical pattern. A similar pattern is shown at FIG. 4 where 12 shaped charges are used at the outer and inner rings above the base B of the shaft. It is to be noted that in these patterns, shown at FIGS. 1 and 4, the central portion of the shaft floor is not covered by a shaped charge. With such an arrangement, the rock at the floor B of the shaft will, nevertheless be shattered with somewhat larger pieces at the center of the shaft and smaller pieces at each side of the shaft. Should it be desirable to break up the rock more completely, an arrangement such as that illustrated at Fig. 5 can be used where shaped charges cover the entire floor B of the shaft. The arrangements illustrated are general, and similar types of symmetrical arrangements of shaped charges may be used for penetrating the floor of a shaft. The walls W of the shaft may easily be held within tolerable limits, once the side wall spacing '*y*' of the outer charges is established.

Figure 6:
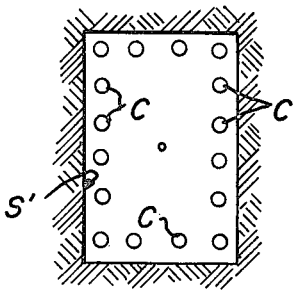
FIG. 6 is a diagrammatic view showing the bottom of a rectangular shaft and an array of shaped charges for driving the shaft.

A shaft S need not be circular in section and FIG. 6 indicates a suitable arrangement of shaped charges C for driving a rectangular shaft S'. A rectangular pattern of shaped charges is positioned adjacent to the walls of the shaft S' and upon detonation, the walls will be maintained while the rock at the center of the rectangular shaft will be broken up to the point where it can be excavated. If necessary, a few shaped charges, not shown, can be located at the longitudinal center line of the rectangular shaft to more effectively break up the rock.

As shown in FIG. 2, the individual shaped charges are positioned at about 3 plus diameters apart (based on the diameter of the charges and from center line to center line). In FIG. 4, the changes are indicated as from about 1 plus to 2 plus diameter apart, and in FIG. 5, the changes are indicated as from about 1 plus diameter to over 2 diameters apart. But as stated, the spacing determined by the target rock, and as set out in my U.S. Pat. No. 3,741,119, above referred to, spacing of the individual charges may be from about 1.2 to over 4 or more diameters apart.

Figure 7:
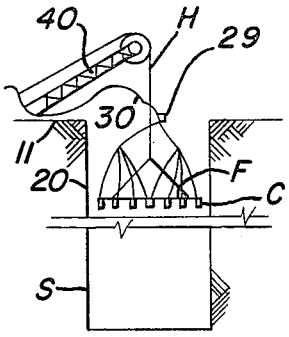
FIGS. 7, 8, 9 and 10 depict diagrammatically a sequence of operations for driving a vertical shaft in accordance with the principles of the present invention.
Figure 8:
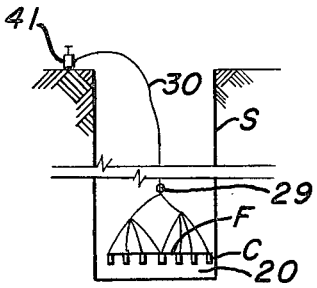

FIGS. 7 – 10 illustrate the essential steps required in driving a vertical shaft S downwardly into rock according to the principles of the invention. The operations, or steps, as with conventional shaft driving operations, are cyclic and repeat as the depth of the shaft increases. FIG. 7 illustrates a shaft S with the floor B clearned of loose rock and already to receive a frame work carrying shaped charges. A framework F, carrying the shaped charges C, is lowered into this shaft by a hoist line H as from a hoist 40. This framework is carefully centered at the bottom of the shaft and is supported upon the standoff legs 20 at a proper distance above the floor B. As the hoist lowers the framework into the shaft, the electrical wire 30 connecting with the detonating cap 29 which, in turn, connects with the fuses 27, is also lowered into the shaft. Once the framework F rests upon its standoff legs 20, the hoist line H and the sling ropes 25 withdrawn from the shaft, as illustrated at FIG. 8. This completes the first step of operation, that is, placing an array of spaced charges in the shaft at a proper position above the floor of the shaft. It is to be noted that the framework F will be destroyed when the spaced charges are detonated and that additional frameworks can be manufactured and prepared with charges ahead of time or during the other operations.

Figure 9:
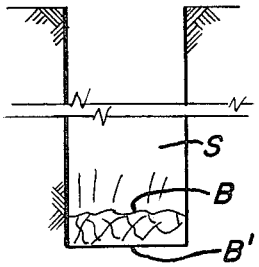

FIG. 9 indicates the second step of the boring operation, that is, detonation. This is effected by an electrical current through the wire 30 as from a generator 41 at the top of the shaft. The shaped charges will effectively completely destroy the framework F, especially if it is made of wood, and at the same time, they will penetrate the floor surface B a depth of several feet, ordinarily from 3 to 5 feet, to break up the rock beneath the floor B for subsequent excavation. It is to be noted that a simultaneous blast from a number of shaped charges will create an intense shock wave which is directed upwardly and out of the shaft. Thus, no significant damage should occur especially if some provision is made to protect people and equipment in the immediate vicinity from falling debris, primarily parts of the framework F and rock.

Figure 10:
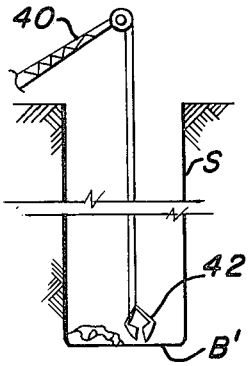

FIG. 10 indicates the final step of the boring operation, the mucking out of the shattered rock. The hoist 40 is again brought into play and a pickup such as a clamshell bucket 42 is lowered into the shaft to muck out the loose rock. Properly positioned, the spaced charges will break up the rock below the floor of the shaft in a surprisingly uniform manner and trimming operations are usually unnecessary. Moreover, it may not even be necessary to lower a workman into the shaft S to prepare for placement of the next framework F carrying shaped charges for continuation of the boring operations.

It is to be noted that these boring operations may proceed even with the shaft filled with water. The shaped charges C′ are modified to permit them to rest upon the floor of the shaft, and the frame standoff legs 20 are eliminated. The operations are essentially the same as above described, although it is to be noted that mucking is a submerged operation.

Figure 11:
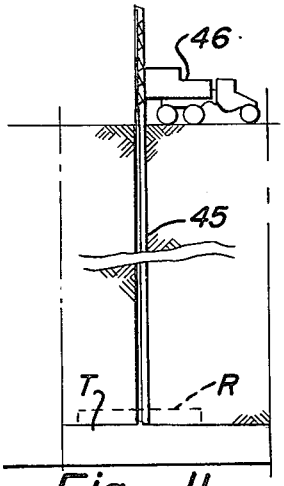
FIGS. 11, 12 and 13 depict diagrammatically a sequence of operations for the uphole drilling of a shaft where an access tunnel is available at the bottom of the shaft.
Figure 12:
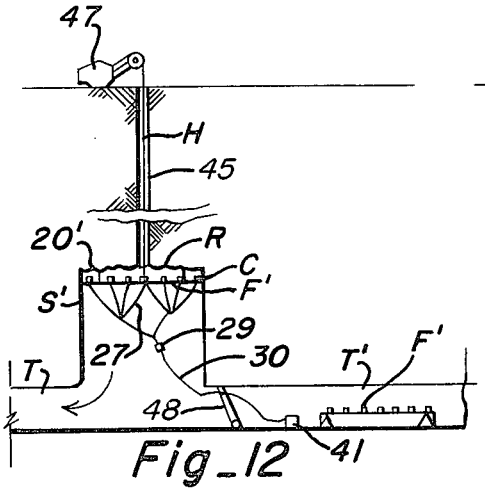
Figure 13:
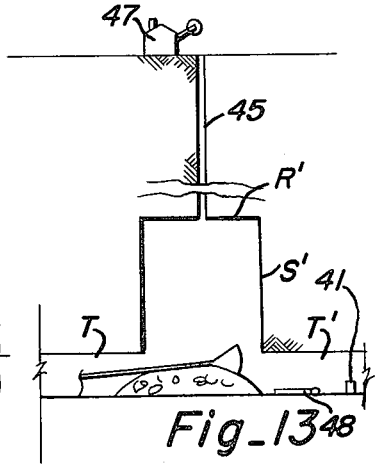

The present invention can be used very effectively to replace the conventional, rapid, uphole method for boring vertical shafts and the essential steps for doing this are illustrated at FIGS. 11, 12 and 13. As with conventional operations, the prerequisite to driving an uphole shaft S′ is an access and haulage tunnel T to permit workmen to prepare the charges for placement in the shaft and to permit them to muck out and remove the blasted rock. The first step of an uphole operation according to the present invention is, as indicated at FIG. 11, to drill a small diameter lead hole 45 from the upper work, or ground, surface to the tunnel T. This can be done quickly and cheaply with a conventional rotary drill rig 46. A hoist drum 47 is then located at the ground surface to drop a hoist line H downwardly through this lead hole 45 to the tunnel T.

The next step is to prepare the bottom portion of the shaft S′ at the tunnel by increasing the width of the tunnel, if necessary, and forming a roof portion R of the shaft to facilitate placement of the shaped charges against this shaft roof, which commences at the tunnel or a short distance thereabove as shown in broken lines at FIG. 11.

Once these preparatory steps are completed, the operations proceed according to repeated steps. A frameowork F′, similar to the frame F, is prepared with the shaped charges C being directed upwardly and with the standoff legs 20′ extending upwardly to engage the roof R of the shaft S. The hoist line h is necessarily attached to the frame F′ at a single, central point at or close to the balance of the point of the frame so that the hoist line may be pulled upwardly through the lead hole to hold the frame against the roof of the shaft S′. At the same time, the fuses 27 and the electrical wire 30 will hang downwardly from the frame to extend to and into the tunnel T. Thus, when the frame and its shaped charges are held in position against the roof R of the shaft, the placement step is completed and the charges are ready for detonation.

If the workmen setting the charges cannot leave the tunnel before the shaped charges are detonated, they must retreat to a safe portion T′ of the tunnel opposite the tunnel exit to avoid the force of escaping gases when the shaped charges detonate. Also, a bulkhead 48 may be placed in this tunnel portion T′ to close it, protecting the workmen from intense shock waves which will occur upon detonation of the spaced charges. They will have the blasting generator 41 within this protected tunnel portion T′, and the workmen can prepare additional frames F′ in this area.

When the upwardly directed shaped charges C are detonated, the jets produced will penetrate the rock above the shaft roof R to break up rock which drops into the tunnel T. After the gases in the tunnel T are removed to permit access by workmen, the broken rock must be removed from the tunnel T and the mucking operation may be done in any conventional manner as with a mucking machine or with a slush mucking drag shovel as illustrated. Once the mucking is completed, another set of spaced charges, upon another framework F', will be hoisted to the newly roof R' to continue the uphole boring operation for the shaft S'.

Figure 14:
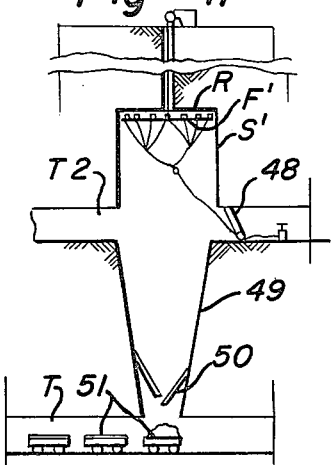
FIG. 14 depicts diagrammatically, one step in uphole driving of a shaft according to the operations shown at FIGS. 11-13 where a second access level is above the haulage tunnel and may be used by the operators for loading and detonating the charges.

FIG. 14 shows a modification of the uphole boring method where a second tunnel T2 is located above the haulage tunnel T. The shaft S' commences at the upper tunnel T2 and a chute 49, which may function as a hopper, interconnects the upper and lower tunnels. A gate 50, located at the base of this chute 49, will control the feed of broken rock to mine cars 51 in the lower tunnel T. The operations of placing a frame F', carrying spaced charges, at the roof R of the shaft to drive the shaft upwardly, are essentially the same as heretofore described. The workmen will use the upper tunnel for makeup of frames F' and charges, preferably behind a bulkhead 48 for shelter during detonation.

Figure 15:
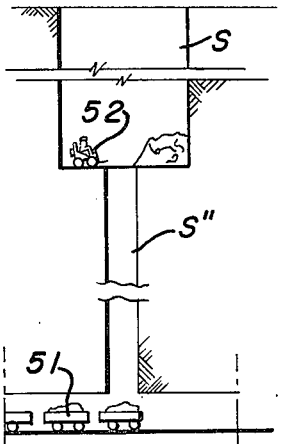
FIG. 15 depicts diagrammatically one step in a downhole operation where a vertical shaft is being enlarged according to the present invention.

FIG. 15 shows another modification wherein the invention is used for enlarging an existing shaft S''. The downshaft boring operations are substantially the same as heretofore described in connection with FIGS. 7 – 10. However, the spaced charges C on a frame F will not be directed into the existing shaft S'' but only about it. In this operation, broken rock may drop down the existing shaft S'' and into mine cars 51 in a tunnel at the bottom of the shaft. A suitable hopper and gate arrangement, not shown, may be used at the bottom of the shaft if necessary to control the flow of broken rock into the mine cars. In this modified operation, the mucking steps will be changed in that whenever detonation of the shaped charges occurs to drive the enlarged shaft S downwardly, a large amount of broken rock will fall down the old shaft. Then a small loader 52 may be lowered into the enlarged shaft S to push the remainder of the muck into the existing shaft S''.

Figure 16:
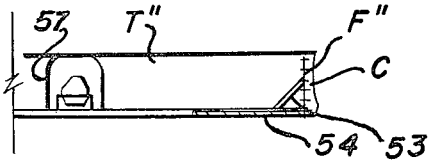
FIG. 16 depicts diagrammatically one step in driving a tunnel with shaped charges.

FIG. 16 illustrates how the present invention can be used for drilling a horizontal tunnel T''. A frame F'', essentially the same as that heretofore described, is prepared to carry an array of shaped charges C, and the frame is modified only by providing a brace 53 to hold it upright against the face of the tunnel. A muck plate 54 may be placed upon the floor of the tunnel back of the frame, and the charges are then ready for detonation. After detonation, the rock and debris may be mucked onto cars 51 and another frame F'' of shaped charges may be positioned at the advanced face of the drift.

In using the shaped charges for this type of operation, it is important that the tunnel include a side branch 57 adjacent to the face of the drift so that men and machinery can retreat to a shelter out of the way of the blast effect when detonation occurs. A bulkhead 48, as heretofore described, is desirable to close off this branch.

Figure 17:
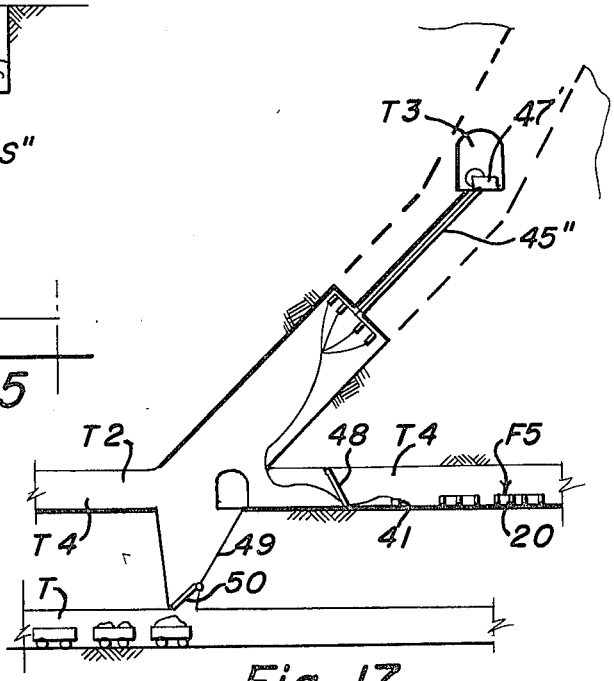
FIG. 17 depicts diagrammatically an arrangement where shaped charges are used for stoping a vein between two access levels.

FIG. 17 illustrates a situation where the present invention can be used for boring an inclined shaft, or for stoping where an inclined vein is comparatively wide and uniform. In a convenient arrangement as illustrated, tupical of many mines, several access tunnels are drifted along the vein at different levels preliminary to stoping between the levels. Three levels are shown herein. A lower haulage tunnel T is provided where mine cars 51 may haul ore out of the mine. A chute 49 and control gate 50 is positioned between this lower level T and an intermediate level T2. The stope is blocked out between this intermediate level T2 and an upper level drift T3.

To prepare for stoping, in accordance with the principles of the invention, a pilot hole 45'' is drilled between the intermediate and the upper level drifts T2 and T3. A shelter room, or tunnel T4 is drilled at the intermediate level to provide room for making up frameworks FS and placing shaped charges upon them. Such frameworks FS are the same as heretofore described in connection with FIGS. 12 and 14, and they may be rectangular and elongate in section. The frameworks are pulled upwardly against the face of the stope, the same as heretofore described. The fuses 27 hang therefrom and the wire 30 extends to the shelter tunnel T4 and to a blast generator 41 behind a bulkhead 48 in that tunnel. The material broken loose as the shaped charge detonates falls to the lower level T2, thence into the chute and to the mine cars at the haulage tunnel T.

It is apparent that in all examples hereinabove set forth, the breaking up of competent rock is rapid and in most instances, far more economical than the conventional drill-load-shoot-muck operations. The invention is especially useful for uphole boring of a shaft where it is not possible to bring heavy mechanical boring equipment to the excavation site. The advantage of the process for downhhole shaft boring resides in the fact that workmen and equipment need not be lowered into and taken out of the shaft for each round of drilling and loading. Considering costs involved, this is significant.

From the detailed descriptions herein set forth, it is obvious that others skilled in the art can devise and build alternate and equivalent arrangements of the physical components and perform similar operations and sequences, all of which are within the spirit and scope of my invention. Hence, I desire that my protection be limited, not by the constructions illustrated and described, but only by the proper scope of the appended claims.

What is claimed is:

1. A method for forming a shaft of a large cross-section of a variable predetermined shaped at any depth through earth material by incremental explosions, comprising the steps:
   a. placing an array of a plurality of individual, and separate from each other, shaped charges at a desired stand-off adjacent to and spaced from the surface of the to-be extended end of the shaft, said charges being positioned and variably spaced apart in a predetermined spaced array, so as to effect a predetermined size of breakage of the material essentially in the predetermined shaped cross-section, for depth of each explosion,
   b. essentially simultaneously detonating said spaced shaped charges,
   c. placing mucking equipment in position to muck the broken material,
   d. mucking the broken material to expose the surface of the end of the shaft, and
   e. repeating the steps until the desired depth of shaft is attained.

2. A method according to claim 1, wherein:
said shaft is formed at an angle to the vertical.

3. A method according to claim 1, wherein:
said shaped charges are prepositioned in the array in a frame remote from the end of the shaft; and
the array in the frame is positioned as a unit adjacent the end of the shaft.

4. A method according to claim 3, wherein:
a pilot bore is formed at any position along the cross-sectional extent of the path and parallel to the axis of the shaft and broken material is removed by dropping it down the pilot shaft.

5. A method according to claim 3, wherein:
forming said frame with standoff legs thereby supporting said charges at the desired standoff height.

6. A method according to claim 3, wherein:
said array and frame are preformed on the surface and lowered to the shaft end by a haul line.

7. A method according to claim 3, wherein:
forming said charges with a hollow bottom to provide the desired standoff and placing said charges to rest on the surface of the shaft end.

8. A method according to claim 7, wherein:
forming said charges with a hollow, water-proof bottom suitable for use in water.

9. A method according to claim 3, wherein:
a pilot bore is formed along the path of the shaft; the shaft is formed from the bottom upwardly; and the shaped charge array and frame is held adjacent the upper end of the shaft by cable means extending through said pilot bore, whereby broken material falls down the formed shaft.

10. A method according to claim 9 wherein:
forming a lateral bore at the bottom of the shaft to permit mucking of the broken material.

11. A method according to claim 9, wherein:
forming intermediate essentially horizontal bores to intercept the shaft providing space for workmen.

12. A method according to claim 11, wherein:
forming the bottom of the formed shaft with a converged bottom thereby forming a hopper for broken material.

* * * * *